United States Patent [19]

Frykendahl

[11] 4,420,031

[45] Dec. 13, 1983

[54] METHOD OF CASTING METAL INCLUDING DISINTEGRATION OF MOLTEN METAL

[75] Inventor: Björn Frykendahl, Erik Dahlbergs Gata 59, 252 40 Helsingborg, Sweden

[73] Assignees: Sven Eketorp, Stora Benhamra; Hasse Fredriksson, Bisittargatan; Per Olof Strandell, Bockstigen; Björn Frykendahl, Helsingborg, all of Sweden

[21] Appl. No.: 350,035

[22] Filed: Feb. 18, 1982

Related U.S. Application Data

[63] Continuation of Ser. No. 127,896, Mar. 6, 1980, abandoned, which is a continuation of Ser. No. 907,963, May 22, 1978, abandoned.

[30] Foreign Application Priority Data

Jun. 8, 1977 [SE] Sweden ..... 7706696

[51] Int. Cl.[3] ..... B22D 11/10; B22D 23/00

[52] U.S. Cl. ..... 164/473; 164/57.1; 164/133

[58] Field of Search ..... 164/46, 57.1, 66.1, 164/133, 335, 418, 437, 473; 75/0.5 C; 266/202, 216; 264/12; 425/7

[56] References Cited

U.S. PATENT DOCUMENTS

| | | | |
|---|---|---|---|
| 1,323,583 | 12/1919 | Earnshaw | 164/133 X |
| 3,089,767 | 5/1963 | Rinesch | 164/56.1 X |
| 3,357,692 | 12/1967 | Bakkerus | 266/216 |
| 3,826,301 | 7/1974 | Brooks | 164/46 |
| 3,891,730 | 6/1975 | Wessel et al. | 264/12 X |
| 4,114,251 | 9/1978 | Southern et al. | 164/46 X |
| 4,116,656 | 9/1978 | Mukai et al. | 264/12 X |

FOREIGN PATENT DOCUMENTS

| | | | |
|---|---|---|---|
| 2150591 | 4/1973 | France | 164/122 |
| 537204 | 6/1941 | United Kingdom | 164/57.1 |
| 384915 | 9/1973 | U.S.S.R. | 75/0.5 C |

*Primary Examiner*—Nicholas P. Godici
*Assistant Examiner*—J. Reed Batten, Jr.
*Attorney, Agent, or Firm*—LeBlanc, Nolan, Shur & Nies

[57] ABSTRACT

A method and apparatus for casting molten metal into ingots or bars. The molten metal is first disintegrated (fragmented) by a gas, via a lance jet, the gas including a powdered material of the same material as the molten metal and/or another material, to obtain a mixture of disintegrated molten metal and powder which is collected in a collector. The molten metal from a container pressurized by the gas is caused to flow out of an outlet in the container, and the gas containing the powder of pre-determined quantity and composition is caused to flow out from the mouth of a lance-shaped tube, the outlet end of which is surrounded by molten metal and is situated in or at the container outlet at which stage the molten metal is disintegrated and mixed with the gas contained powder and the resultant disintegrated molten metal mixed with powder grains is collected as an ingot or bar in the collector (mould).

8 Claims, 3 Drawing Figures

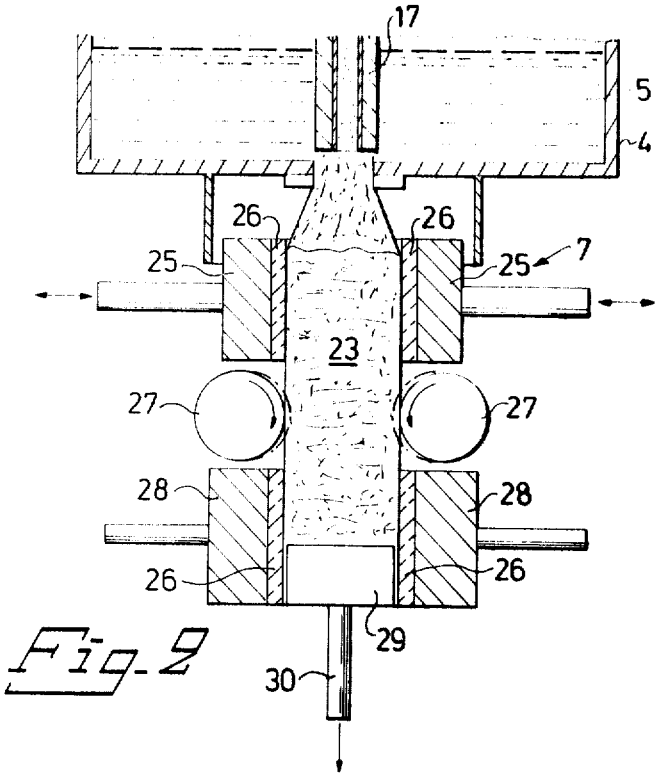
Fig. 2
Fig. 3
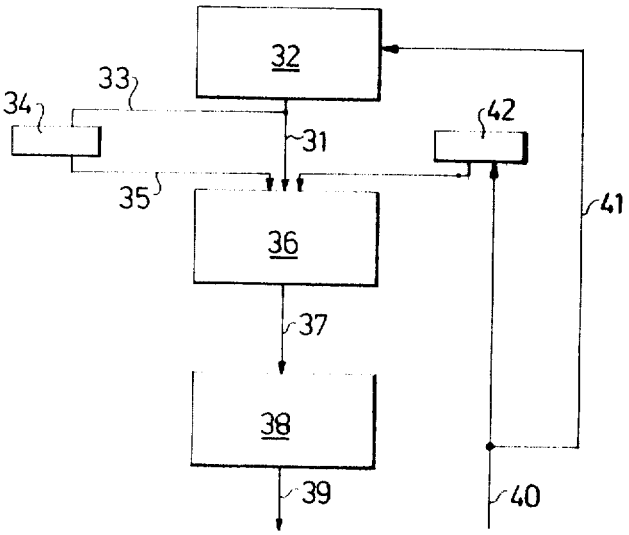

METHOD OF CASTING METAL INCLUDING DISINTEGRATION OF MOLTEN METAL

CROSS-REFERENCE TO RELATED APPLICATIONS

This application is a continuation of application Ser. No. 127,896, filed Mar. 6, 1980 which is, in turn, a continuation of application Ser. No. 907,963, filed May 22, 1978 both now abandoned.

BACKGROUND OF THE INVENTION

The present invention concerns a method for casting molten metal into ingots or bars (billets) and an apparatus for the execution of the method.

Normally, molten metal is cast (teemed) in a chill mold, either intermittently into individual ingots or continuously into continuous castings. Most of the surplus heat from the molten metal is dissipated via the chill mold, whereby the metal solidifies. The central portion of the ingot will therefore solidify much later and more slowly than the surface layer, due primarily to the greater heat transmission distance and the higher thermal resistance to the surplus heat in the central portion, whereby temperature gradients are created through the cross-section of the ingot.

Due to the fact that the central portion of the ingot solidifies at a slower rate than the surface, the central portion exhibits a completely different solidification structure and a different chemical composition than the rest of the ingot. Furthermore, porosities, cracks and other flaws form readily in the central portion. These deffects are more serious in higher-alloyed metals, since the solidification gradient is greater.

Compositional differences between precipitated solid phase and molten metal, so-called segregations, can be counteracted on a macro-scale by means of a higher and more uniform rate of cooling of the molten metal and by an equalization of temperature differences by means of stirring in the liquid phase.

Owing to the high segregation tendency of the alloying components in e.g. high-alloyed tool steels, such steels have been cast in relatively small-sized ingots (weighing around 200 kg). In this way, an acceptable carbide precipitation structure is obtained, possessing satisfactory strength properties. However, a material with a more or less isotropic structure cannot be produced by means of this method.

A cast structure possesses a strength which is equal to about 1/100th to 1/1000th of the theoretical possible strength for the metal, due to internal structural inhomogeneties. However, this cast structure is broken down when the material is hot-worked, whereby a homogeneous structure and thereby higher strength is obtained. In exceptional cases, the strength of the material can be increased through hot-working to 1/10th of the theoretically possible strength.

The above-described structural anisotropy can be avoided more or less completely through the use of powder metallurgical processes, where the molten metal is disintegrated (fragmented) by gas or water to a metal powder. The metal powder—which is macroscopically, and even for the most part microscopically, chemically homogeneous—is then compacted by means of e.g. hot extrusion or hot isostatic compression to bars (billets) which are thereby rid completely of macroflaws. The mechanical properties of the resultant sintered material are good and isotropic, so that mechanical working of the material is unnecessary. However, powder metallurgy methods for the production of such sintered bars entail the disadvantage that there is a risk of oxidation and contamination of the metal powder, which impairs the mechanical properties of the bar and thereby the products made from the bar, as well as the disadvantage that the methods are relatively very expensive in terms of the cost of bars and uncomplicated final products.

Recently, attempts have been made to combine into a single operation the gas atomization of the molten metal and the collection of the resultant rapidly-solidified grains (microingots) in a mold to form an ingot. Such an ingot can then be directly hot-forged into a finished, non-porous and structurally isotropic product. (Atomised Scrap Forms Low Cost Forgings. Metals and Materials Nov. 1975, pp 39 and 40.) But this method, like methods where powder is added to gases, entails a major disadvantage, namely that the disintegration medium—which is a gas, in some cases containing powder—must be supplied in relatively large quantities—around 800 liters per kg molten metal—which leads to difficult-to-control turbulence phenomena in and around the collection moulds for the solidified or semi-molten powder grains. These turbulence phenomena result in an uneven distribution of mass in the collection mould, greatly reducing yield. In order to obtain a higher yield, attempts have been made to locate the collection mould closer to the point of disintegration. If this is done, however, the disintegrated molten metal does not have time to solidify before it reaches the mould, which, in combination with the aforementioned turbulence phenomena, causes the particles to stick to the walls of the collection mould to an extent where yield is greatly reduced. Due to these difficulties only very small ingots have been produced by means of this method.

Thus, a method has not yet been known which can be used to make large ingots from a segregation-prone material which are more or less structurally isotropic, and which does not entail the above-mentioned disadvantages associated with the various production methods presently known.

SUMMARY OF THE INVENTION

The present invention offers a method and an apparatus for casting molten metal into ingots or bars which are more or less structurally isotropic without the above-mentioned disadvantages occurring.

Accordingly, the invention relates to a method for casting molten metal into ingots or bars (billets), whereby the molten metal is first disintegrated (fragmented) by a gas which contains a powder made of the same material as the molten metal and/or another material, after which the mixture of disintegrated molten metal and powder obtained in this manner is collected. The invention is distinguished by the fact that molten metal in a container is brought to flow out of an outlet in the container, whereby the aforementioned gas containing the aforementioned powder of pre-determined quantity and composition is brought to flow out of the mouth of a lance-shaped tube or the like, which tube, at least at its mouth end, is completely or partially surrounded by molten metal, and which mouth is situated in or at the aforementioned outlet, whereby the molten metal is disintegrated and mixed with the powder, after which the resultant disintegrated molten metal mixed with powder grains is collected in a collector.

Further, the invention relates to an apparatus for the execution of the above-described method which features the characteristics which are described below.

The invention is described below in greater detail and in reference to enclosed drawings, where:

BRIEF DESCRIPTION OF THE DRAWING

FIG. 2 shows a modification of part of the aforementioned apparatus

FIG. 3 is a flow scheme for the production of ingots or bars in accordance with the invention.

DESCRIPTION OF THE METHOD AND PREFERRED EMBODIMENTS

Figure 1:
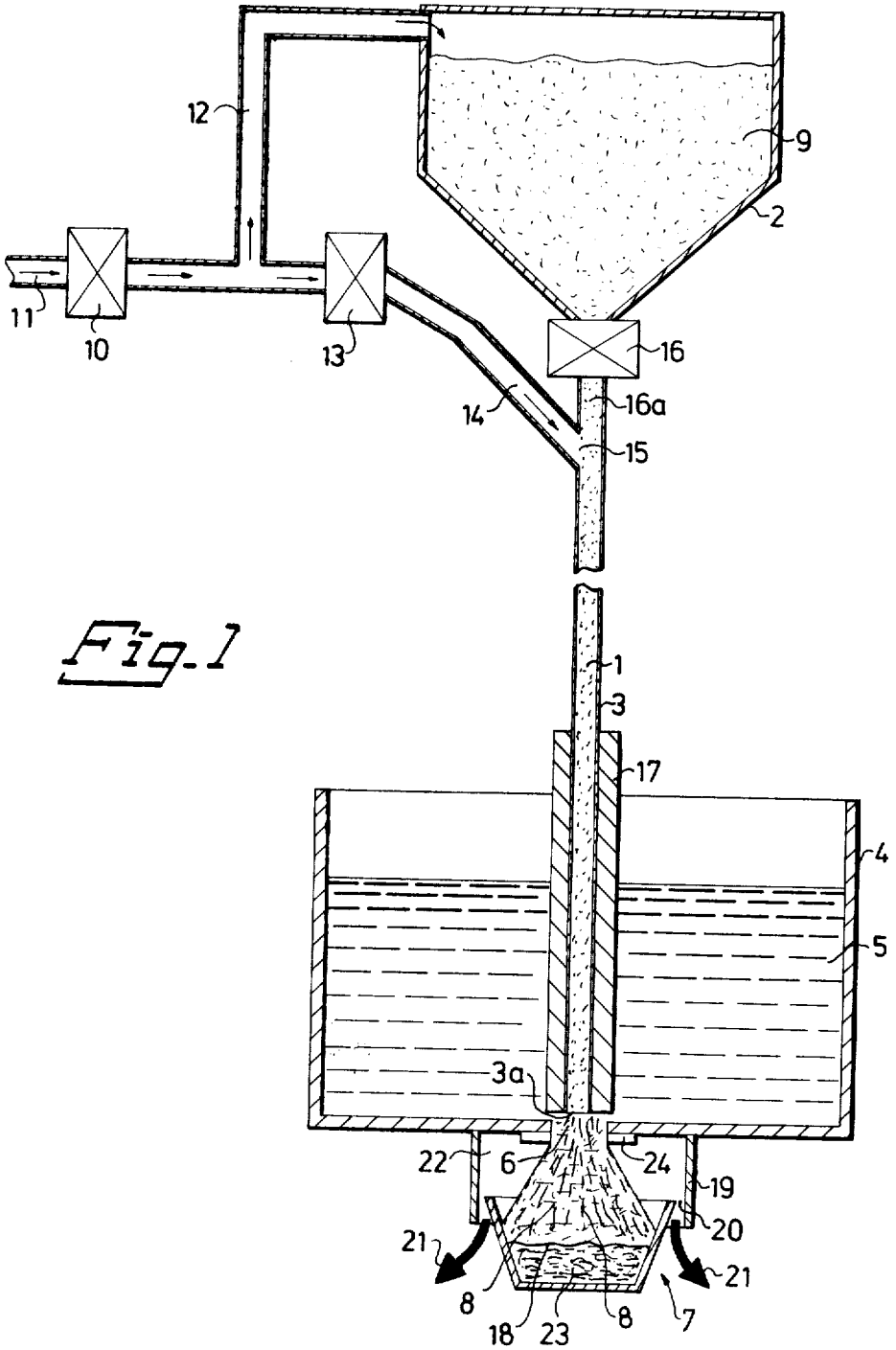
FIG. 1 is a schematic drawing of an apparatus in accordance with the invention.

In this method in accordance with the invention, molten metal 5 in a container 4 is brought to flow out of an outlet 6 in the container, whereby a gas 11 containing a certain quantity of cold powder 9 is brought to flow out the mouth of a lance-shaped tube 3, which mouth 3*a* is situated in or at the aforementioned outlet 6. When the molten metal 5 flows out of the outlet 6, it is disintegrated by the expanding gas 11 issuing from the lance 3, which gas contains cold powder 9 of a predetermined quantity and composition. FIG. 1 illustrates a version of the invention where the lance 3 is positioned concentrically with the outlet 6. The molten metal 5 thereby forms a contracting jet which is disintegrated by powder-carrying gas 1, which is expanding from the centre of the jet radially outward and axially. When the molten metal is thus disintegrated by a gas which expands from inside the molten metal outward, a considerably lower gas pressure is required than if the metal jet were to be disintegrated by a gas acting on the jet from the outside, as in currently known methods. The powder 9 is entrained in the gas stream and contributes effectively towards the disintegration of the metal jet. The molten metal 5 is fragmented into tiny elements which are completely or partially separate from each other. These tiny elements are collected in the space underneath the outlet 6 in a collector 7 to form an ingot or bar 23. Under the influence of the elements' internal kinetic and potential energy, the elements are consolidated into an ingot or bar 23 of high density, when they meet a surface which is fixed in relation to them. Any gas porosity in the ingots or bars can easily be removed by means of hot working.

The mixture 8 of the tiny elements and the powder grains introduced via the gas leads to the rapid cooling of the elements under rapid heating of the powder grains through heat transfer from the elements to the powder grains. The quantity of powder 9 introduced via the gas 11 is adjusted so that the elements and the powder grains assume a temperature which is close to the solidification temperature of the material mixture.

The method in accordance with the invention thus entails that the distance between the outlet 6 and the collector 7 can be relatively small. Furthermore, the invention entails that smaller quantities of gas per unit time are required to disintegrate the molten metal—less than 50–100 l/kg metal, as compared with conventional methods where gas is used as the disintegrating medium—due to the introduction of cold powder via the gas, whereby the aforementioned unfavourable turbulence phenomena are avoided. Thus, the use of the method in accordance with the invention results in a relatively uniform distribution of mass in the mould in the collector 7.

Owing to the high cooling rate whih is achieved in the above-described manner, the segregation distance on a micro-scale is very small, owing to the fact that more numerous solid phase nuclei form when the cooling rate increases. As a result, the collected material in the form of an ingot or a bar 23 possesses a microscopically and macroscopically very uniform chemical composition and a very uniform temperature distribution ovver an arbitrarily chosen cross-section. An ingot or a bar 23 produced in accordance with the present invention possesses a strength which is about 1/20th to 1/10th of the theoretically possible strength prior to working. The collected material 23 can therefore be directly hot-formed into a finished product, with, if desired small reductions in working. The working further increases the strength of the material. A prerequisite for the above-described disintegration of the molten metal 5 is that the pressure of the injected gas 11 is greater than the metallostatic pressure prevailing in the outlet 6 and the pressure prevailing in the space underneath the outlet. The gas 11 shall constitute a gas or a gas mixture which does not have an adverse effect on the metal 5, for example gaseous nitrogen. The primary function of the powder carried by the injected gas is, as has been mentioned above, to facilitate the disintegration of the molten metal, to bring about a uniform temperature distribution and to provide uniformly distributed nuclei for the formation of molten elements, in an arbitrarily chosen section in the material approaching the collection mould. Depending on the quantity and composition of the cold powder, various purposes can be achieved. In order to produce ingots or bars 23 which are microscopically and macroscopically homogeneous, it is advisable to choose a powder 9 which is compositionally equivalent to the molten metal 5 and has an average grain size of around 150 μm or less. This metal powder 9 can be obtained by gas atomization in the conventional manner of a compositionally equivalent molten metal. The metal powder is dosed in such a quantity that the average temperature in the resultant ingot or bar is equal to the solidification temperature of the metal. In addition to the fact that a very homogeneous temperature distribution and compositionally uniform structure are obtained due to the very rapid and uniform transfer of heat between the elements of the disintegrated molten metal and the injected cold metal powder, other advantages are also obtained. One advantage is that the shrinkage which is otherwise normal when molten metal solidifies and which causes cavities in the ingot or the bar 23 is largely compensated for by the expansion of the metal powder 9 in connection with the heat transfer. Another advantage is that the formation of secondary non-metallic inclusions, such as oxides and sulphides, is suppressed.

It can be mentioned that in order to completely cover the surplus heat and heat of solidification in a 1600° C. metal bath which is compositionally equivalent to an ordinary high-alloyed tool steel, a quantity of compositionally equivalent metal powder equal to about 35–40% of the weight of the molten metal must be introduced, depending somewhat on the heat losses of molten metal in the outlet and in the underlying space.

The method in accordance with the invention for the casting of molten metal naturally also permits the use of a smaller quantity of metal powder than that required to cover the surplus heat and the heat of solidification, in order to obtain a good structure and an acceptable temperature distribution in molten metals containing constituents of a less segregation-prone nature.

Another possibility permitted by the proposed method for the casting of molten metal is that the metal powder 9 which is compositionally equivalent to the molten metal 5 be replaced with another powder of metallic or non-metallic composition. The effect of this option is to considerably increase nucleus formation by the solid phases formed from the molten metal, or to produce a composite material consisting of a pure meal containing particles of, for example, an abrasion-resistant carbide which are uniformly distributed in an arbitrary cross-section.

FIG. 1 and FIG. 2 show how the mixture 1 of gas 11 and cold powder 9 of desired composition and quantity is introduced from a powder container 2 through a lance-shaped tube 3 to a bottom outlet 6 in the container 4 for the molten metal 5, underneath which a suitable collector 7 for the mixture 8 of the disintegrated molten metal and the powder is situated. The gas 11 is supplied through a line via a first flow-limiting valve 10 and a second flow-limiting valve 13 to the lance 3. The powder 9 is stored in the powder container 2 in the bottom of which is a quantity-limiting valve 16 through which the powder 9 is fed into the lance 3. Between the first 10 and the second 13 flow-limiting valves is a connecting tube 12 with a upper part of the powder container 2. The gas flow can be varied by means of the second flow-limiting valve 13 in order to regulate the pressure which is exerted by the gas on the powder in the powder container 2. By means of a suitable adjustment of the aforementioned valves 10, 13 and 16, the quantity of powder 9 in the gas 11 in the lance 3 can be adjusted to a predetermined value. An injector 15 is located at the point of juncture of the gas line 14 and a flow line **16*a* coming from the quantity-limiting valve 16, whose purpose is to provide a uniform mixture of powder 9 with gas 11. The lance 3 is immersed in the molten metal 5 to such a position that its mouth 3*a* is situated in connection with the outlet 6 from the container 4 for the molten metal 5. FIGS. 1 and 2 show the mouth 3*a* of the lance 3 situated concentrically with the outlet 6. The lance 3 is fitted with a protective casing 17 to protect it against the molten metal 5. The casing 17 is made of a material which is resistant to the molten metal, such as aluminium oxide where the molten metal is steel. In order to protect the environment underneath the container 4 and surrounding the collector 7 against metal spatter and in order to protect the disintegrated molten metal and the top surface 18 of the ingot 23 against the adverse effect of the ambient atmosphere, such as oxidation, a protective collar 19 of suitable material is fitted underneath the container 4. The collar 19 is designed in such a manner that a suitable gap 20 is formed between the inside surface of the collar 19 and the collector 7 for the passage of the gas 21, which is now free of molten metal and particles. The injected gas 11 thereby acts as a shielding gas 22 throughout the entire procedure of casting of the ingot or bar 23. The outflow of molten metal 5 can be regulated by the creation of a suitable outlet area by regulation of the distance of the tubular lance 3 from the outlet 6 of the container 4 and/or by a valve 24, for example a solenoid-type valve, acting in the outlet 6. The valve 24 may also permit total shut-off of the flow of molten metal. Such shut-off can otherwise be accomplished by, for example, a sliding disc. The collector 7 may be of the chill mould type, as shown in FIG. 1, and may be semi-continuous or fully-continuous with respect to the formation of the ingot or bar 23. FIG. 2 is a schematic illustration of a collector (generally designated by the numeral 7) of the continuous type, where the ingot 23 is collected and shaped by a mould which vibrates in the collection plane and is split into two or more parts with vertical walls, called shapers 25, which are designed to give the ingot or bar the desired cross-sectional shape, i.e. square or round. The shapers 25 may be lined with a temperature- and wear-resistant pad 26. This pad 26 should be temperature-insulating in order to maintain a uniform distribution of temperature over the entire ingot 23. Fixed leaders 28 and a set of rolls 27 transport the ingot 23 from the collection plane in order to achieve continuity in casting. The rolls 27 are driven by a drive device (not shown in the figure) and may be arranged so that they reduce the ingot 23 slightly. The fixed leaders 28 may be lined with pads 26 which possess the same properties as the pads 26 on the vibrating shapers 25. At the start of casting, the mixture 8 of the disintegrated molten metal and injected powder is deposited on the starter head 29, after which the starter head is drawn through the shapers, rolls and leaders by a rod 30**.

FIG. 3 is a schematic flow chart for ingot or bar production based on the method in accordance with the present invention. A desired quantity 31 of molten metal from a source of molten metal 32 of desired composition is fed to an apparatus 36 of the present invention corresponding to that described in FIG. 1 or 2. A remaining portion of the molten metal 33 is disintegrated by means of a known method in apparatus 34 suitable for the purpose, for example a presently known apparatus to accomplish gas or water disintegration, to form particles of uniform composition and structure, whose average size should be less than 150 μm. These particles 35 are delivered to the powder container on the casting device 36 of the present invention. Casting proceeds in the afore-described manner. After the casting device 36, the resulting ingot or bar 37 can be transported to an apparatus 38 for mechanical working of the ingot or bar in order to shape it and to remove any pores or cavities which may have formed in connection with casting. In the latter case, the ingot or bar should be protected against the ambient atmosphere, e.g. by a shielding gas, in order to prevent oxidation, if a fine surface finish is required. After mechanical working, the resulting ingot or bar 39 is now ready for further processing, such as further shaping and/or heat treatment.

Any scrap 40 remaining after casting of the molten metal can either be returned as represented by path 41 to the starting melt 32 or, after e.g. cryogenic fine-fragmentation 42 to particles of size 150 μm or less, be delivered 43 directly to the powder container on the casting apparatus 36.

The method and apparatus in accordance with the invention thus make it possible to disintegrate molten metal into tiny elements and immediately thereafter collect the material in a suitable collector, with a uniform distribution of mass in the collected material. Furthermore, the material is cooled very rapidly, leading to very little microsegregation and macrosegregation in the resultant ingot or bar, thus producing a highly structural isotropic material.

The costs of fabricating ingots or bars in accordance with the invention are considerably lower than the costs of conventional powder material production, since compacting and special treatment and working under shielding gas are not required with the present invention.

The invention thus permits a very high-quality material to be produced at a low cost.

The invention shall not be regarded as being confined to the above-described examples, but rather as being variable within the framework laid down by the appended patent claims.

I claim:

1. Method for casting molten metal into ingot bars, whereby the molten metal is first disintegrated into fragments by a gas containing a powdered material, after which the resultant mixture of fragmented molten metal and powder is collected, comprising the steps of: providing a container having an outlet in the bottom wall thereof and a lance-shaped tube disposed therein aligned with said outlet; disposing molten metal within said container such that said tube, at its mouth end, is at least partially surrounded by said molten metal; flowing said molten metal from said container through said outlet; pressurizing a supply means containing a powdered metallic material; mixing gas with said powdered metallic material; forcing the gas containing said powdered metallic material through and out said mouth end of said tube, introducing a uniform mixture of the gas and powdered metallic material simultaneously in the center of the molten metal stream flowing from the container outlet, disintegrating the molten metal stream with said gas and powdered metallic material mixture, the quantity of powder mixed with the quantity of molten metal being in a predetermined proportion such that a major portion of the mixture of the powder and molten metal upon disintegration by the gas stream and mixed with the powder, assumes a temperature of at least as much as the solidification temperature of the material mixture, and collecting the resultant semi-solidified mixture of fragmented molten metal mixed with metallic powder grains in a collector.

2. Method in accordance with claim 1, further characterized by the step of positioning the afore-mentioned lance-shaped tube so that its mouth is situated essentially concentrically with the afore-mentioned outlet.

3. Method in accordance with claim 2, further characterized by the step of regulating the flow of molten metal through the outlet of varying the distance between the mouth of the lance-shaped tube and the outlet by displacement of the lance-shaped tube in relation to the container.

4. Method in accordance with claim 1, further characterized by the step of discharging to atmosphere, the gas issuing after the disintegration of the molten metal, via a gap for such discharge of gas being provided between a collar projecting from the bottom of the container around the outlet and the collector; such gas discharge being to prevent penetration of the ambient atmosphere into the zone for the disintegration and collection of the material mixture.

5. Method in accordance with claim 1, further characterized by the steps of collecting the mixed materials in a mould consisting primarily of vertical walls and a bottom, said bottom in the initial stage, consists of a starter head and then of the surface of collected material; and then lowering said mould with starter head and the collected material mixture during collecting at such a rate that the distance of the aforementioned bottom to the outlet is maintained substantially constant.

6. Method in accordance with claim 1, further characterized in that the powdered metallic material added to the molten metal in said forcing and introducing steps is in a proportion equal to about 35 to 40 percent of the weight of the molten metal.

7. Method in accordance with claim 1, further characterized by the molten metal being steel.

8. Method in accordance with claim 1, further characterized by the powdered material being of similar metallic composition to the molten metal.

* * * * *